United States Patent [19]

Turner et al.

[11] 4,236,441

[45] Dec. 2, 1980

[54] FIELD ARTILLERY AMMUNITION SUPPORT VEHICLE

[75] Inventors: John Turner; Richard A. Koster; Seymour Bassman, all of York, Pa.

[73] Assignee: Harsco Corporation, Harrisburg, Pa.

[21] Appl. No.: 32,908

[22] Filed: Apr. 24, 1979

[51] Int. Cl.[3] ..... F41H 7/02

[52] U.S. Cl. ..... 89/40 F

[58] Field of Search ..... 89/36 H, 40 B, 40 F, 89/40 P, 45, 46, 47

[56] References Cited

U.S. PATENT DOCUMENTS

| | | | |
|---|---|---|---|
| 1,230,687 | 6/1917 | Driggs | 89/40 B |
| 1,295,177 | 2/1919 | Krzyzanowski | 89/40 B |

FOREIGN PATENT DOCUMENTS

| | | | |
|---|---|---|---|
| 150980 | 12/1920 | United Kingdom | 89/40 F |

*Primary Examiner*—Stephen C. Bentley

*Attorney, Agent, or Firm*—Kerkam, Stowell, Kondracki & Clarke

[57] ABSTRACT

A field artillery ammunition support vehicle is mounted on an armored tracked chassis and has an armored body providing protection for the driver and for the crew within the vehicle. Within the armored body of the vehicle racks are provided for the projectiles and compartments are provided for the propellant charges. A vertical elevator is disposed within the vehicle body adjacent the projectile racks to receive projectiles and to carry them to a horizontally disposed conveyor which conveys the projectiles through a rear opening of the vehicle and into the adjacent gun vehicle when in firing position, the rear opening of the support vehicle having an armored door which is raised when supplying the gun vehicle to provide added protection for gun and vehicle crews. Compartments along the inner sides of the support vehicle body or housing carry the propellant charges which are placed on the conveyor behind each projectile for movement to the gun vehicle. The racks containing the projectiles may be individually loaded with projectiles at the ammunition dump by reverse movement of the conveyor and elevator or the empty racks may be lifted through a hatch in the top of the support vehicle and replaced with racks already loaded with projectiles. The projectile racks may also be removed and replaced when the vehicle is to supply a different caliber projectile.

A powered hoist is mounted within the support vehicle for purposes of replacing the projectile racks and/or for replacing them with loaded projectile racks.

10 Claims, 12 Drawing Figures

FIELD ARTILLERY AMMUNITION SUPPORT VEHICLE

BACKGROUND OF THE INVENTION

Self-propelled field artillery weapons have been widely used and in some of these the weapon is loaded and fired from the outside of the vehicle while in others the gun crew is sheltered within the armor of the vehicle during loading and firing of the weapon. More recently, the United States Army self-propelled artillery weapon M109 has been widely used and in this weapon the gun crew is housed within the armored vehicle body during service of the weapon. The Model M109 and similar vehicles usually mount a 155 mm gun or an 8-inch gun, and both of these are separately loading, that is, the projectile is loaded in the chamber followed by the propellant and the detonator is then put in place to complete the loading of the weapon.

Such fast self-propelled field artillery weapons usually carry ammunition within the armored housing of the vehicle but this ammunition must be readily and promptly resupplied during active engagement of the weapon. Heretofore, such ammunition supply has been carried out by conventional vehicles such as trucks, half-tracked vehicles, and the like, depending upon the terrain, but it is highly desirable that these field artillery weapons be supported by support vehicles which are at least equally fast and equally maneuverable as well as provided with armored protection for the supply vehicle during movement and also during its supply function adjacent the weapon.

To this end, the field artillery support vehicle of the present invention is mounted upon the chassis of the M109 field artillery weapon or other suitable similar chassis, and is provided with an armored housing mounted thereon providing armored protection for the driver of the vehicle and crew of the vehicle, as well as armored protection for the ammunition carried by the support vehicle. Racks are provided within the vehicle for the individual projectiles and compartments are provided for the propellant charges and particular means are also provided for loading the vehicle at an ammunition dump and for feeding the projectiles and propellant from the vehicle to the gun when the vehicle is in gun-supply position.

BRIEF SUMMARY OF THE INVENTION

A field artillery support vehicle has a self-propelled chassis with an armored housing thereon. Compartments are disposed along the interior sides of the housing for propellant charges. A plurality of cells, each receiving a projectile, are disposed adjacent each other across the interior of the housing toward the front of the housing. A powered elevator is mounted in the housing adjacent the cells for handling a projectile at a selected cell and a reversible powered conveyor in the housing extending from adjacent the elevator to adjacent the rear of the housing moves projectiles and propellant charges.

BRIEF DESCRIPTION OF DRAWINGS

In the accompanying drawings, in which like reference characters indicate like parts, a preferred embodiment of the present invention is shown in which.

DESCRIPTION OF PREFERRED EMBODIMENT

Figure 1:
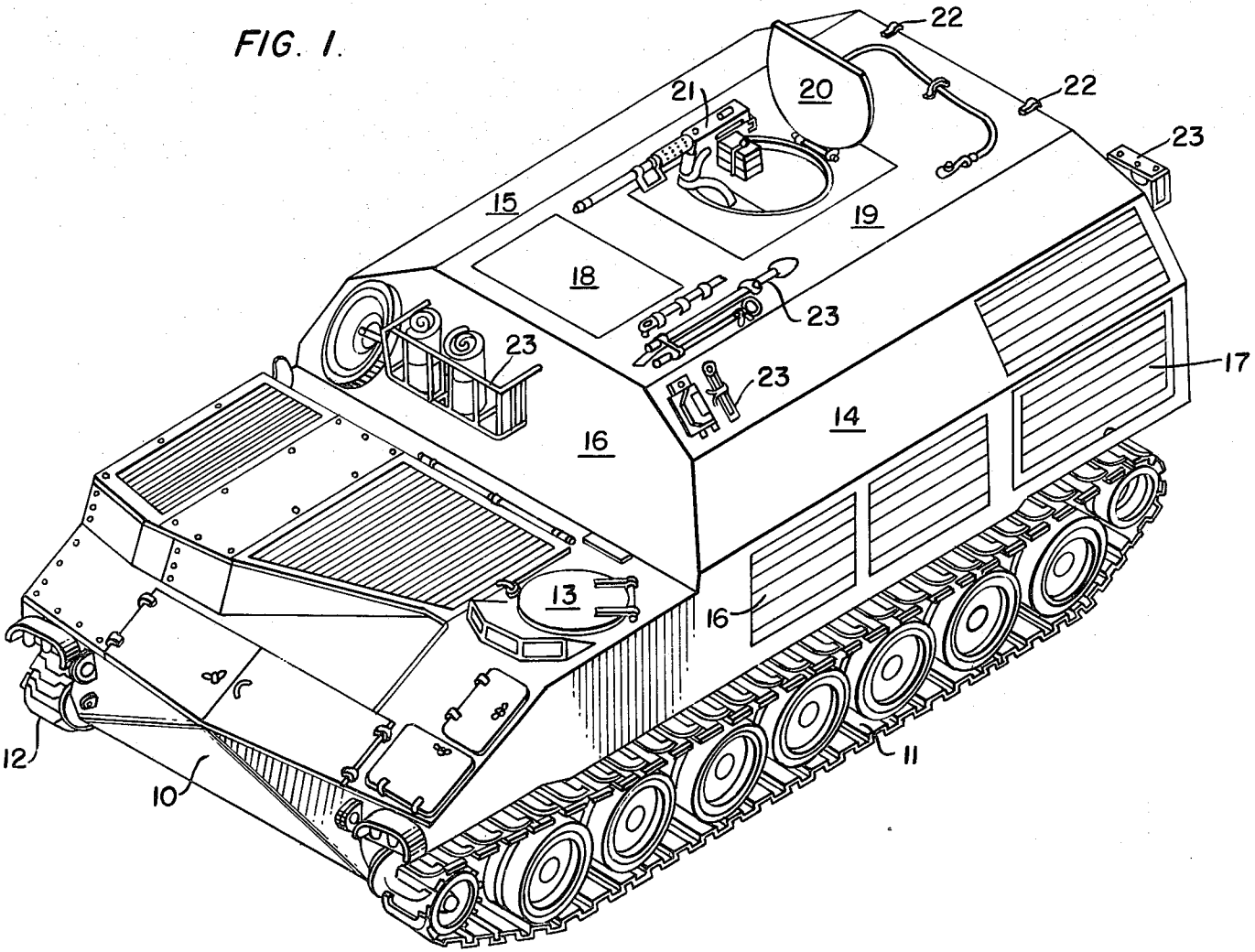
FIG. 1 is a view from the front and above of the present field artillery support vehicle mounted on a self-propelled tracked chassis having an armored body to protect the crew and the ammunition carried therein.

Referring to FIG. 1, the field artillery support vehicle of the present invention is there seen mounted on a self-propelled armored chassis 10, supported and moved by tracks 11 and 12 in well known and conventional manner, the tracks being driven by a suitable internal combustion engine, usually diesel, and gear train, (not shown), and having an armored driver position 13. An armored housing forming a body is mounted on chassis 10 and is provided with sloping sides 14 and 15, a sloping front 16 and with the sides of the housing being provided with side doors 16' and 17 with ventilation openings for the propellant compartments to vent the effects of canister burning and for loading canisters from the side. An armored hatch 18 is provided in the top 19 of the housing for purposes which will hereinafter appear and the housing may also have a hatch 20 and cover and a weapon 21 mounted therein for protection of the vehicle. Hinges 22 are mounted at the rear of the housing to support a rear armored door which when raised will provide added protection for the crew and the usual and conventional racks 23 may be mounted on the outside of the housing or body to carry necessary equipment.

Figure 2:
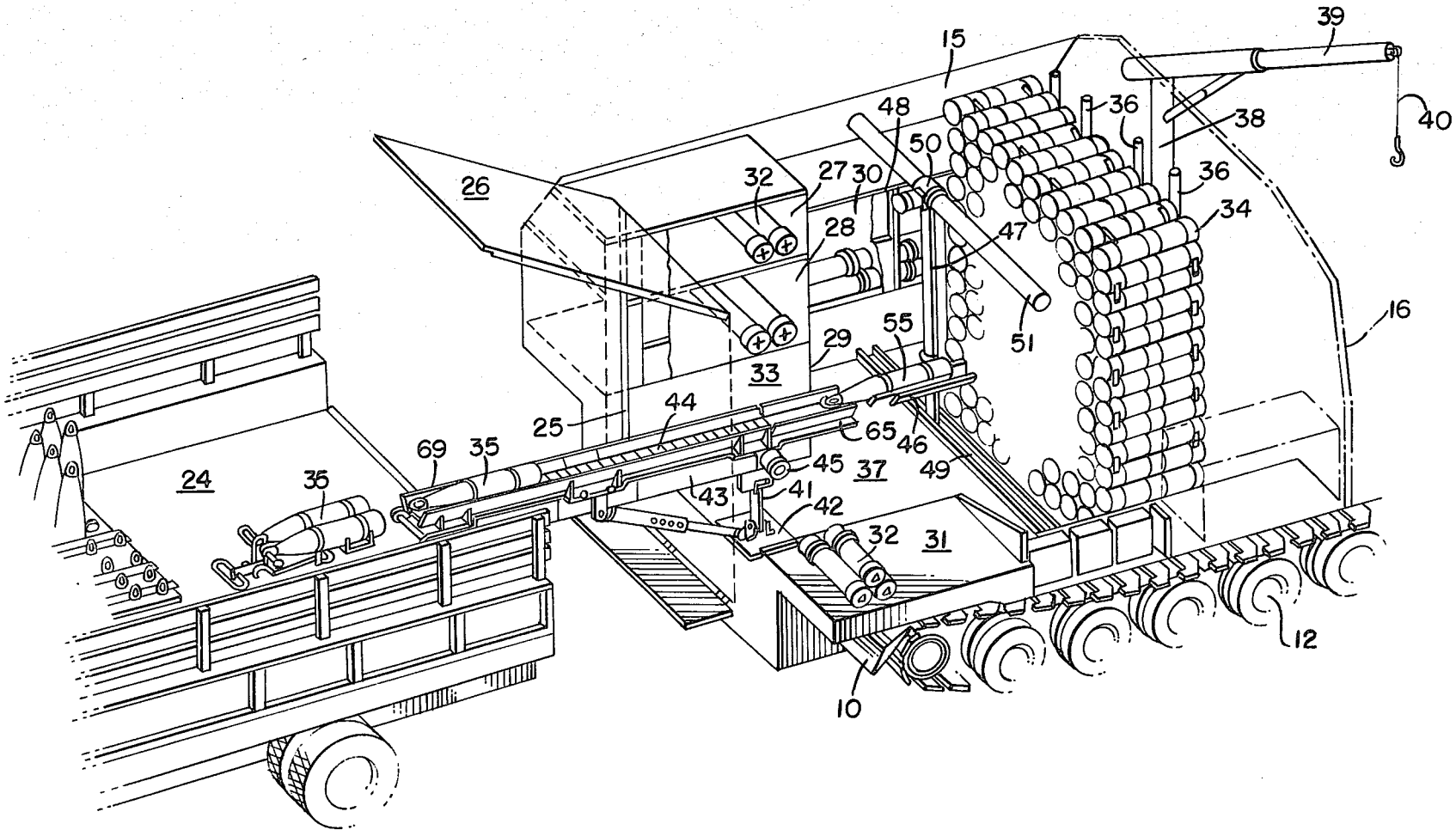
FIG. 2 is a view of a rear portion of the vehicle of FIG. 1 cut away to show the interior thereof and to illustrate the procedure utilized in loading the support vehicle from an ammunition supply, here shown as a truck.

As seen in FIG. 2, the housing of the field artillery support vehicle is cut away to show the interior thereof, the positioning of the projectile racks or cells and the propellant charges bins. In this figure the field artillery support vehicle is being loaded with projectiles and propellant charges from a suitable source of ammunition, such as an ammunition dump or a truck 24. The rear of the housing of the support vehicle is provided with an opening 25 having an armored door 26 mounted upon hinges 22 of FIG. 1. Compartments such as compartments 27, 28, 29, 30, and 31 of suitable armored material are secured integrally within and along the side walls of the vehicle housing to receive the propellant charges 32 in conventional containers and each of the compartments is provided with a vertically sliding closure or door 33 so that each compartment may be maintained closed except when propellant charges 32 are being removed therefrom to minimize the occurrence of fire or explosion.

Arranged across the interior of the vehicle housing and behind the motor compartment are racks or cells 34 for projectiles or clips of projectiles 35, a single projectile 35 being here shown as contained within each of the cells 34. Each projectile 35 is suitably secured in its cell so that it cannot be removed accidentally as during movement of the support vehicle. The racks or cells 34 are manufactured in units of ten or any suitable number and are mounted on vertically disposed support rods 36 extending from the floor of the vehicle 37 to adjacent the opening of hatch 18 of FIG. 1. This construction will be described in more detail in connection with FIGS. 11 and 12.

An hydraulically actuated and extensible crane 38 having a boom 39 and a cable and hook 40 is mounted on floor 37 in front of cells 34 and is utilized, as will appear more fully hereinafter, in removing and replacing the cell units, elements 38 and 39 extending above hatch 18 (FIG. 1) when in use.

A pedestal 41 mounted on base 42 which is secured to floor 37 is located within the vehicle housing and centrally of opening 25 and supports a conveyor generally shown at 43 for horizontal rotation which will be described in detail in connection with FIGS. 4, 5, 6 and 7. For present purposes, conveyor 43 includes a conveyor belt 44 driven by a motor 45, which motor 45 may be reversed to drive belt 44 in either direction. As shown in FIG. 2, the outboard end of conveyor 43 rests upon the floor of truck 24 and is in position to receive projectiles 35 therefrom. Belt 44 is then actuated through motor 45 to move toward the right as seen in FIG. 2 so that a projectile or clip of projectiles 35 is moved from truck 24 into the housing of the supply vehicle and is there received on tray 46 of elevator 47 which is powered by motor 48. The base of elevator 47 slides in tracks 49 mounted on floor 37 across the vehicle housing and the upper end of elevator 47 is provided with tubular sleeve 50 sliding on cross bar 51 extending internally within the housing from slanting slides 14 and 15. When a projectile 35 is on tray 46, a crew member actuates elevator 47 to bring tray 46 opposite an empty cell 34 and the projectile 35 is then manually slid into that cell and secured in position therein. This will be described hereinafter in more detail in connection with FIGS. 8 and 9.

Propellant charges in conventional containers 32 are also carried by truck 24 or separately and are likewise brought into the support vehicle by conveyor 43 and stacked in the several compartments 27–31 disposed along the inner sides of the vehicle housing.

Figures 4, 5, 6, 7:
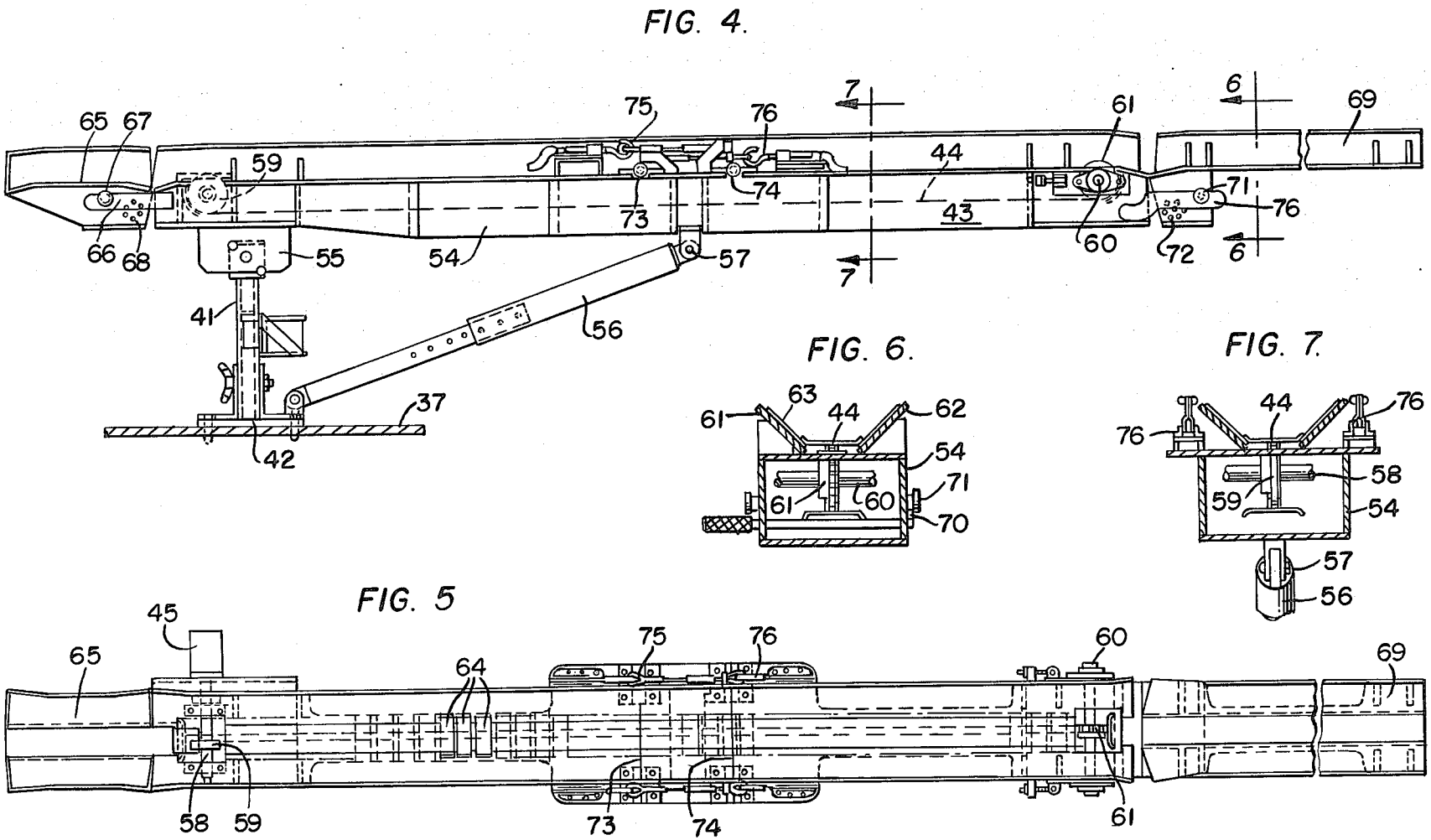
FIG. 4 is a side view of the conveyor for projectiles and propellant charges seen in FIGS. 2 and 3.
FIG. 5 is a view from above of the conveyor of FIG. 4.
FIG. 6 is a cross-sectional view on the line 6—6 of FIG. 4.
FIG. 7 is a cross-sectional view of the conveyor on the line 7—7 of FIG.4.

When the support vehicle is loaded with projectiles and propellant charges, conveyor 43 is folded about pivots provided in its construction as will appear from the description of FIG. 4 so that the conveyor is totally contained within the support vehicle housing whereupon door 26 is lowered to close opening 25 and is secured and the vehicle is ready for movement to gun supporting position.

Figure 3:
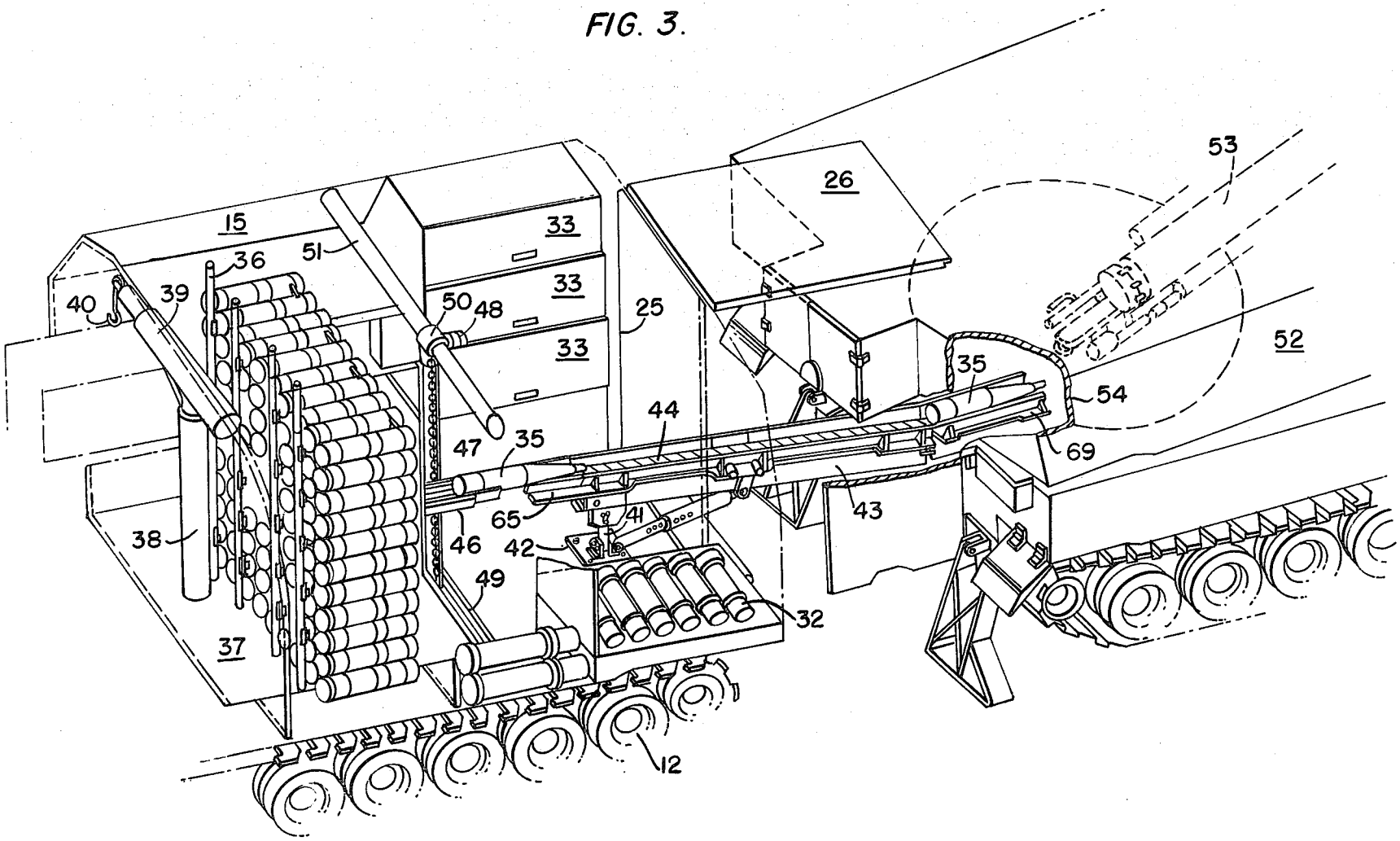
FIG. 3 is a view of the rear portion of the vehicle of FIG. 1 partially cut away showing the vehicle in position for supplying ammunition to an implaced self-propelled field artillery weapon.

In FIG. 3 the field artillery support vehicle shown in part therein is in position adjacent the gun vehicle for supplying separate loading ammunition thereto. The gun vehicle is generally indicated at 52 and the gun 53 thereof is serviced by the gun crew within the gun vehicle. The gun vehicle is provided in conventional manner with a suitable rear hatch or opening 54. The elements of conveyor 43 are unfolded and the conveyor extends into gun vehicle 52 through hatch 54 so that projectiles and propellant charges moving on belt 44 are moved into the gun vehicle for use of the gun crew. The crew of the support vehicle then utilizes elevator 47 to position tray 46 opposite a cell 34 from which at least one projectile 35 is to be removed and, when a projectile 35 is on tray 46, actuates elevator 47 to bring tray 46 into extension with the inboard end of conveyor 43 so that the projectile 35 may be received on belt 44, belt 44 then being actuated by motor 45 to move the projectile 35 to the right, as seen in FIG. 3, and into the gun vehicle. The propellant charges in containers 32 are also placed by the supply vehicle crew on belt 44 following each projectile to provide the separate loading components to the gun crew.

The position of the support vehicle may be adapted to that of the gun vehicle so that only minor adjustments need be made to the positioning of conveyor 43.

Conveyor 43, referred to above, is shown in detail in FIGS. 4–7. It will be seen that conveyor 43 has a hollow box frame 54 provided with downwardly extending structure 55 for engagement with pedestal 41 for horizontal rotation thereon. Frame 54 is held in horizontal position by adjustable strut 56 which is pivoted thereto at 57 and is also pivotally connected to base 42. Motor 45 is mounted adjacent the inboard end of frame 54 and drives shaft 58 which in turn mounts pulley 59 which drives endless conveyor belt 44. The outboard end of frame 54 carries shaft 60 which mounts roller 61 about which endless conveyor 44 is mounted. Angularly disposed side elements 61 and 62 are mounted on top of frame 54 and conveyor 44 runs in the apex thereof. Sides 61 and 62 may be lined with a suitable low friction material 63 such as "Nylon".

Endless conveyor 44 may be made up of a plurality of flexibly interlocking links 64.

A tray 65 is removably mounted on the inboard end of frame 54 by extensions 66 thereof which receive studs 67 and the alignment of tray 65 is provided by the insertion of a suitable pin in an appropriate opening 68 in tray 65. Tray 65 is of the same general configuration as the side elements 61 and 62 and receives a projectile or clip of projectiles from tray 46 of elevator 47 prior to the projectile being moved by conveyor 44.

The outboard end of frame 54 is provided with a removable tray 69 which is mounted on extensions 70 of frame 54 by means of studs 71 and the alignment thereof with conveyor 44 is provided by a pin mounted in an appropriate opening 72. As seen in FIG. 3, tray 60 receives a projectile from conveyor 44 and holds the projectile until it can be removed by the gun crew. In this connection, tray 69 has the same general configuration as sides 61 and 62 of frame member 54.

As noted above, conveyor 43 is pivoted centrally so that the same may be folded back upon itself for complete containment within the field artillery support vehicle when not in use. To this end, trays 65 and 69 are readily removable when the conveyor is not to be used and frame member 54 is provided with pivot lines 73 and 74 so that the right side of frame 54 as seen in FIG.

4 may be rotated about these pivot lines and back onto the left portion of frame 54 for complete containment within the support vehicle. Suitable latches 75 and 76 arranged for manual operation are provided to lock the conveyor in extended position as seen in FIGS. 4 and 5.

Conveyor 54 may be rotated on pedestal 41 for use through side doors 16' or 17 when required.

Figure 8:
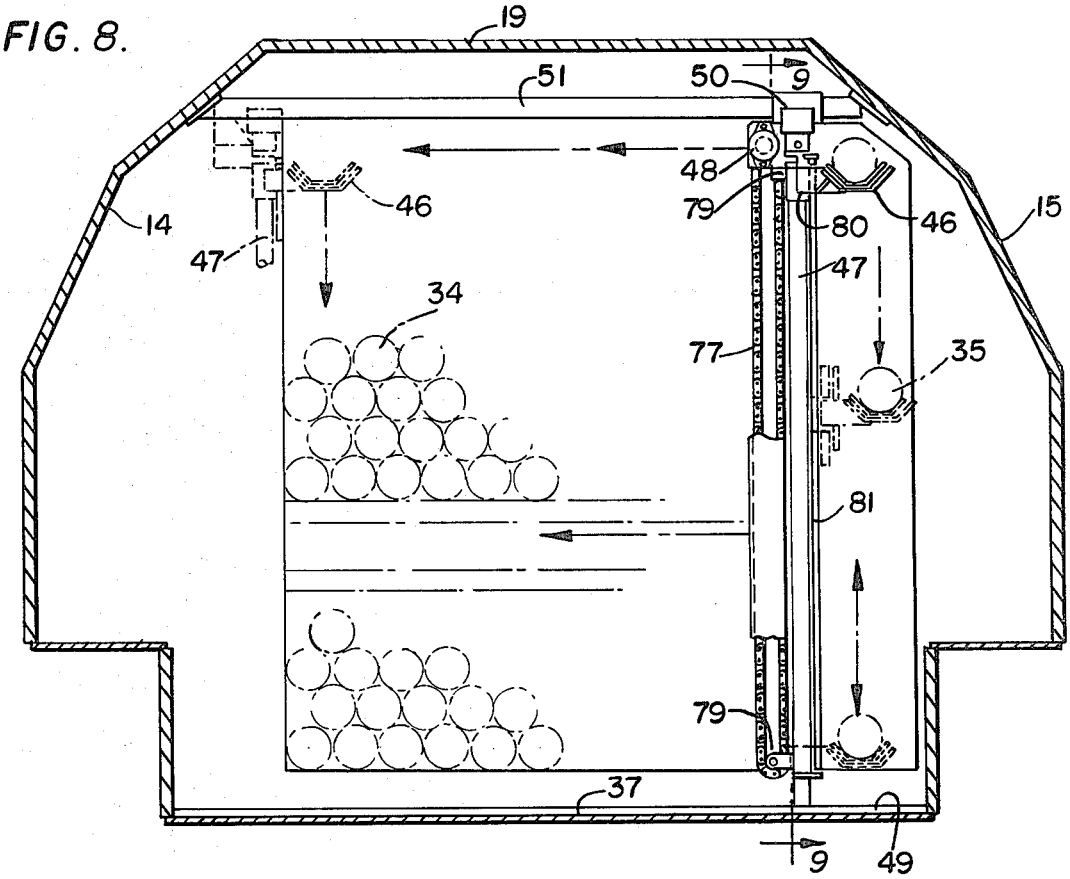
FIG. 8 is a cross-sectional view of the armored body or housing of the vehicle of FIG. 1 at the rear of the projectile supporting racks or cells to illustrate the operation of the elevator for moving the projectiles from the racks or cells.
Figure 9:
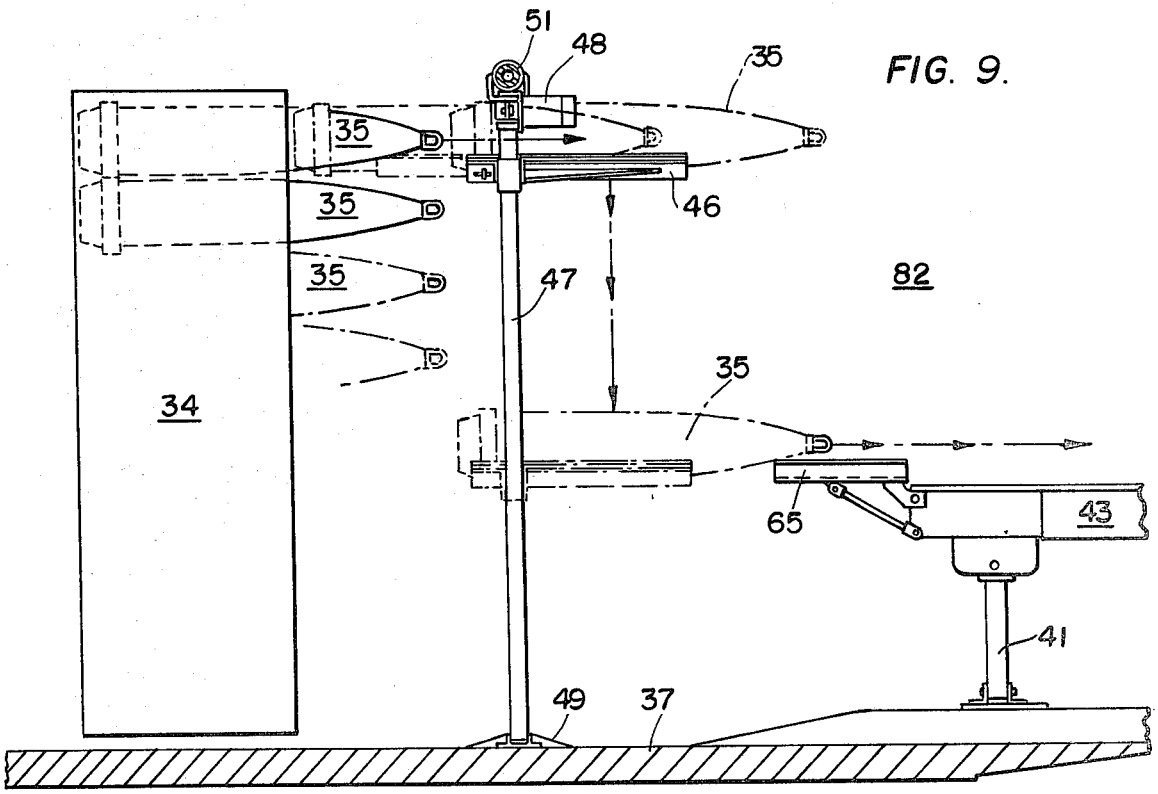
FIG. 9 is a view of the line 9—9 of FIG. 8 and including a rear portion of the conveyor.
Figure 10:
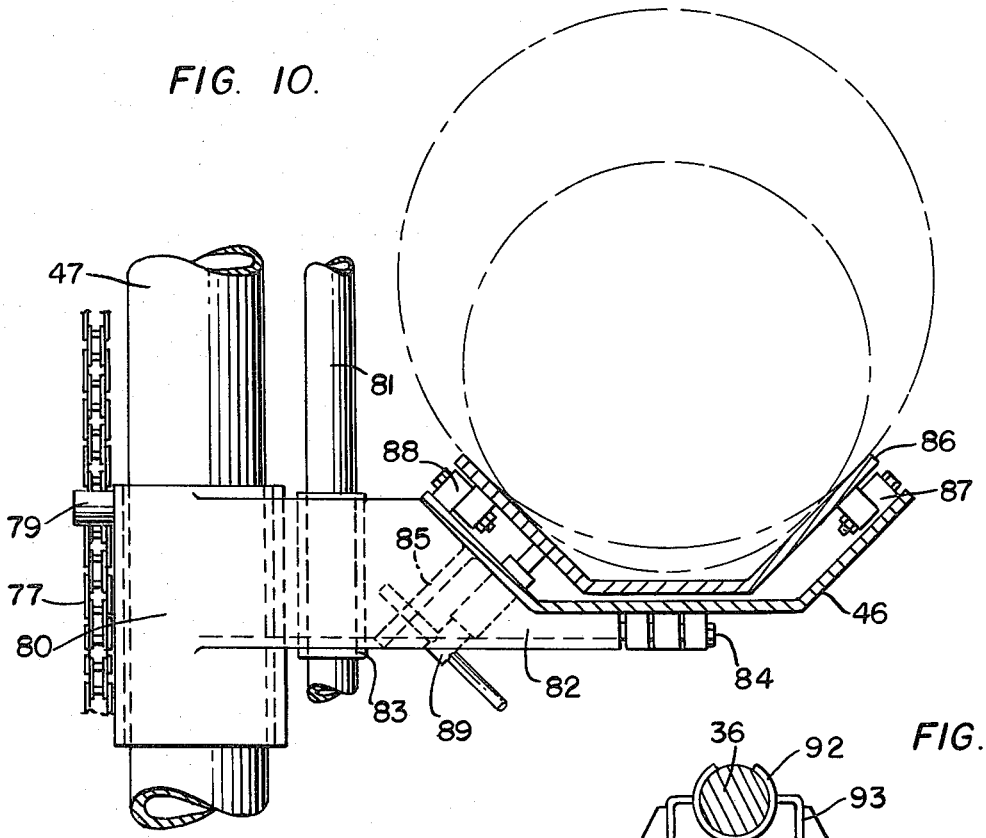
FIG. 10 is an enlarged detail, partly in section, of the projectile supporting tray of the elevator of FIG. 8.

The elevator discussed above in connection with the handling of projectiles adjacent cells 34 is shown in further detail in FIGS. 8, 9 and 10 where motor 48 is seen as driving endless chain 77 which turns around sprocket 78 mounted at the base of upright 47. Tray 46 is mounted on sleeve 80 for sliding movement on upright 47 and sleeve 80 is connected to chain 77 at 79. An alignment post 81 extends between the top and bottom of upright 47 and is spaced therefrom and passes through sleeve 80 secured to tray 46 to prevent rotation of tray 46 about upright 47.

With reference to FIG. 10, tray 46 is shown as connected to sleeve 80 by arms 82 and arms 82 mount sleeve 83 which slides on guide post 81. Tray 86 pivots slightly with respect to arms 82 and bolt 84 and is held in adjusted position by set bolt 85. An auxiliary tray 86 is pivotally mounted within tray 46 at 87 and 88 and is held in adjusted position by set bolt 89. These adjustments for the positioning of tray 46 and auxiliary tray 86 are provided to permit movement of the projectiles or clips of projectiles onto and off of tray 46 with minimum manual effort.

Figure 11:
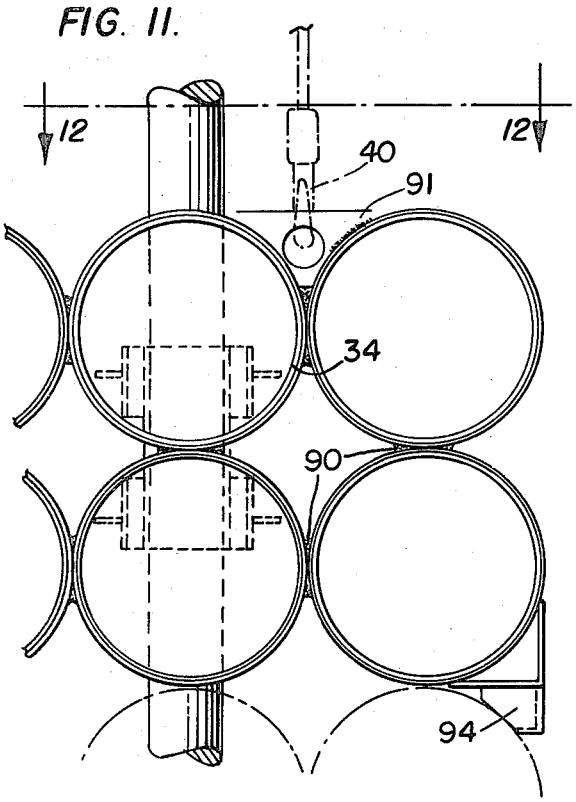
FIG. 11 is an enlarged detail of the structure for mounting the projectile racks or cells in the vehicle; and, FIG. 12 is a view on the line 12—12 of the structure of FIG. 11.
Figure 12:
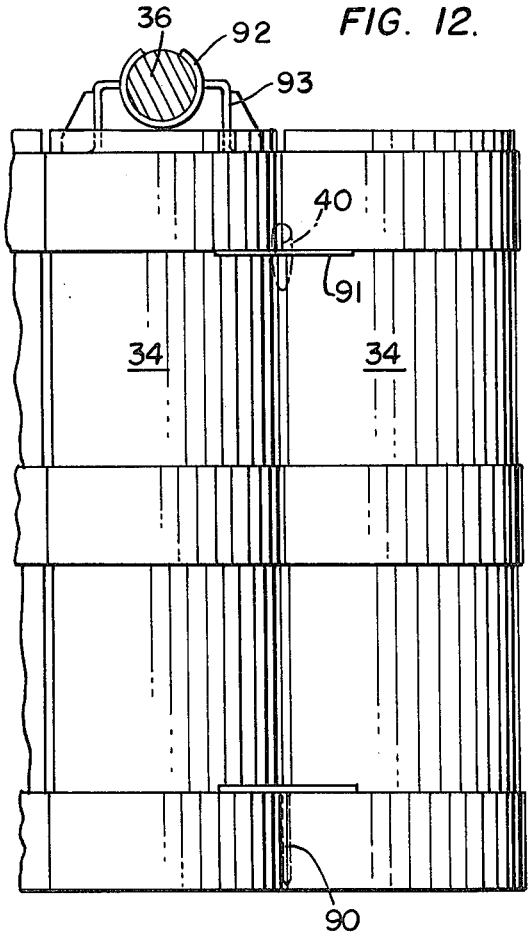

Details of the cell construction for holding projectiles in the support vehicle as discussed above and referred to by reference numeral 34 are seen in FIGS. 11 and 12. As above noted, cells 34 are assembled in units of ten each, five across and two in height or in any other suitable number, and are hollow metal cylinders secured by welding 90 where they engage. Each set of ten cells is provided with a plate 91 secured centrally thereof to receive hook 40 so that the unit may be readily mounted in or removed from the support vehicle. To this end, each unit of ten cells is provided with two spaced vertically disposed sleeves 92 suitably secured thereto by webs 93 with sleeves 92 slidably mounted on posts 36. Each unit of ten cells may also be provided adjacent the bottom edges thereof with guide members 94 for engagement with either the floor of the vehicle or with the next adjacent cell 34. It is therefore readily apparent that the cells 34 for holding projectiles in the support vehicle may be readily removed in units of ten when reloading the vehicle or when a different caliber of ammunition is to be carried by a crew member employing hoist 38 and working through open hatch 18.

Motors 45 and 48 and hoist 38 may be powered either hydraulically or by electricity sources of hydraulic fluid under pressure and of electricity being readily available within the self-propelled vehicle chassis 10.

We claim:

1. A field artillery ammunition support vehicle having a self-propelled armored tracked chassis and a forward driving position comprising:

an armored enclosed housing mounted on the chassis behind the driving position;

a rear wall for said housing away from the driving position;

an armored door in said rear wall, spaced side walls and a front wall for said housing;

compartments disposed within said housing along said side walls for receiving propellant charges;

door closing said compartments;

a plurality of adjacent cells disposed within and adjacent a side wall to adjacent the other side wall of said housing and spaced from said front wall for receiving at least one projectile in each of said cells;

an elevator movably mounted within said housing adjacent said cells for receiving at least one projectile from a selected one of said cells;

a horizontally disposed conveyor mounted within said housing and between said elevator and said door for moving projectiles from said elevator through said door;

reversible power means driving said elevator, and reversible power means driving said conveyor.

2. A vehicle as described in claim 1, said cells being removable and further including a hatch in said housing, an armored closure for said hatch, said hatch being adjacent said cells and a powered hoist mounted in said housing beneath said hatch for moving said cells into and out of said housing.

3. A vehicle as described in claim 2, said cells being connected in separable units of cells, vertical posts mounted in said housing, means on said units of cells for slidably engaging said posts and means on said units of cells for engagement by said hoist.

4. A vehicle as described in claim 1, said elevator including spaced tracks in said housing extending from adjacent a side wall to adjacent the other side wall thereof, a vertical post slidably mounted in said tracks for movement across and adjacent the said cells, a tray mounted for sliding vertical movement on said post and reversible power means for moving said tray on said post, said tray receiving at least one projectile for movement onto and out of a selected one of said cells.

5. A vehicle as described in claim 1, said conveyor including a pedestal mounted within said housing, a frame mounted on said pedestal and extending from adjacent said elevator to adjacent said door, an endless conveyor mounted on said frame for receiving projectiles and reversible power means for driving said endless conveyor.

6. A vehicle as described in claim 5, said conveyor further including a removable tray extension mounted on said frame adjacent said elevator and a removable tray extension mounted on said frame adjacent said door, said trays being in alignment with said endless conveyor.

7. A vehicle as described in claim 5, including a top for said frame, spaced walls secured to said top along the length of said frame and an endless belt for said conveyor moving over said top between said walls.

8. A vehicle as described in claim 5, said frame including two sections pivoted together, a first of said sections being supported by said pedestal and the second of said sections being rotatable about the pivot to lie over said first section when not in use.

9. A field artillery ammunition support vehicle mounted on a self-propelled chassis comprising an armored housing on said chassis, a front wall, a rear wall and spaced side walls for said housing, compartments in said housing along said side walls for propellant charges, armored doors for said compartments, a plurality of adjacent cells disposed from adjacent a side wall to adjacent the other side wall within said housing and spaced from said front wall, each of said cells receiving at least one projectile, a powered elevator mounted in said housing for movement across and adjacent said cells for handling the at least one projectile at a selected one of said cells, an endless conveyor in said housing extending from adjacent said elevator to adjacent said rear wall and reversible power means for driving said endless conveyor, said conveyor moving projectiles and propellant charges.

10. A vehicle as described in claim 9, further including a hatch in said housing adjacent said cells and a powered hoist in said housing between said front wall and said cells for movement of said cells to and from said housing through said hatch.

* * * * *